US005131371A

United States Patent [19]

Wahl et al.

[11] Patent Number: 5,131,371

[45] Date of Patent: Jul. 21, 1992

[54] METHOD AND ARRANGEMENT FOR CONTROLLING A SELF-IGNITING INTERNAL COMBUSTION ENGINE

[75] Inventors: Josef Wahl, Stuttgart; Alf Löffler, Markgröningen-Talhausen; Hermann Grieshaber, Aichtal-Aich; Wilhelm Polach, Möglingen; Ewald Eblen; Joachim Tauscher, both of Stuttgart; Helmut Laufer, Gerlingen; Ulrich Flaig, Markgröningen; Johannes Locher, Stuttgart; Manfred Birk, Oberriexingen; Gerhard Engel, Stuttgart; Alfred Schmitt, Ditzingen, all of Fed. Rep. of Germany; Pierre Lauvin, Francheville, France; Fridolin Piwonka, Markgröningen, Fed. Rep. of Germany; Anton Karle, VS-Villingen, Fed. Rep. of Germany; Hermann Kull; Werner Zimmermann, both of Stuttgart, Fed. Rep. of Germany

[73] Assignee: Robert Bosch GmbH, Stuttgart, Fed. Rep. of Germany

[21] Appl. No.: 578,620

[22] Filed: Sep. 7, 1990

[30] Foreign Application Priority Data

Sep. 7, 1989 [DE] Fed. Rep. of Germany ..... 3929746

[51] Int. Cl.[5] ..... F02D 41/14; F02D 41/38

[52] U.S. Cl. ..... 123/436; 123/458; 123/489; 123/673; 123/676

[58] Field of Search ..... 123/436, 435, 458, 489

[56] References Cited

U.S. PATENT DOCUMENTS

| | | | |
|---|---|---|---|
| 4,426,980 | 1/1984 | Eisele et al. | 123/478 |
| 4,495,920 | 1/1985 | Matsumura et al. | 123/436 |
| 4,616,617 | 10/1986 | Geiger et al. | 123/436 |
| 4,667,634 | 5/1987 | Matsumura et al. | 123/436 |
| 4,688,535 | 8/1987 | Küttner et al. | 123/436 |
| 4,766,863 | 8/1988 | Fujimori | 123/436 |
| 4,869,222 | 9/1989 | Klassen | 123/489 |
| 4,936,277 | 6/1990 | Deutsch et al. | 123/436 |
| 5,020,502 | 6/1991 | Wild | 123/489 |

FOREIGN PATENT DOCUMENTS

| | | | |
|---|---|---|---|
| 3733992 | 4/1988 | Fed. Rep. of Germany . | |
| 59-85432 | 5/1984 | Japan | 123/436 |
| 60-195349 | 10/1985 | Japan . | |

*Primary Examiner*—Andrew M. Dolinar
*Attorney, Agent, or Firm*—Walter Ottesen

[57] ABSTRACT

The invention is directed to a method and arrangement for controlling a self-igniting internal combustion engine. The arrangement includes at least one measured-value sensor, electronic control unit for forming a quantity signal for metering fuel, and a control unit for driving individual actuators for each cylinder. The actuators determine the quantity of fuel injected by the pump elements into the cylinders. Under specific conditions, a corrective unit is activated which determines corrective values specific to the cylinders for making the cylinders equal. The open-loop control unit applies the metering signal to the actuators in dependence upon the quantity signal and the corrective values.

7 Claims, 7 Drawing Sheets

METHOD AND ARRANGEMENT FOR CONTROLLING A SELF-IGNITING INTERNAL COMBUSTION ENGINE

FIELD OF THE INVENTION

The invention relates to a method and arrangement for open-loop controlling and closed-loop controlling a self-igniting combustion engine. The engine includes at least one measured-value sensor, an electronic closed-loop control unit for forming a quantity signal for metering fuel, and an open-loop control unit for driving an actuator specific to a cylinder which determines the quantity of fuel injected by a pump element into a cylinder.

BACKGROUND OF THE INVENTION

Such a method is disclosed in published German patent application DE-OS 37 33 992. In this publication, a method for controlling the metering of fuel for a multi-cylinder engine is described. A fuel pump driven by the engine has several outlets for connecting to corresponding injection nozzles of the engine. Electro-magnetically actuable valves control the quantity of the fuel to be pumped through each outlet. The valves are controlled by a power module in dependence upon a fuel-quantity signal. A comparison circuit compares the engine speed over a working stroke of the engine with the engine speed over the previous working stroke. A distributor device supplies drive signals specific to particular cylinders to the power module in dependence upon this comparison. This method has the disadvantage that the compensating operations are carried out for each combustion cycle and this is associated with a considerable use of computing time.

A method for influencing control variables of an engine is known from U.S. Pat. No. 4,688,535. Vibrating and shaking at idle are based on different fuel quantities which are supplied to the individual cylinders. To prevent the vibrating and shaking, a separate control is provided for each cylinder which determines the quantity of fuel to be injected in dependence upon a desired value and an actual value. Accordingly, a controller is required for each cylinder and this makes it necessary to provide a large number of components. In this method, the corrections must be newly computed for each metering.

Furthermore, an arrangement for drift compensation of fuel-metering systems is known from U.S. Pat. No. 4,426,980. In this arrangement, it is not the metered quantity which is controlled but only the position of an actuator determining quantity. It is an object of this arrangement to maintain the association which initially applied between the total injected fuel quantity and the position signal of the quantity-determining member. Variations in the fuel metered to the individual cylinders are not compensated.

SUMMARY OF THE INVENTION

It is an object of the invention to provide a method and an arrangement for the open-loop and closed-loop control of an internal combustion engine of the kind mentioned above which provide ways to recognize variations in the fuel metered to the individual cylinders of the engine and to compensate therefor. The foregoing should be achieved with the least possible amount of computing time and components.

The method of the invention and the corresponding arrangement affords the advantage with respect to the state of the art that the corrective values can only be computed in the presence of specific operating conditions and then are available for the following metering of fuel. Variations of the quantity of fuel to be injected based on the manufacturing tolerances of the injection system can be corrected with the first operation of the engine. These corrective values are then available for the further operation of the engine and must not be newly computed for each metering. In addition, variations which only occur during operation of the engine are also corrected.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
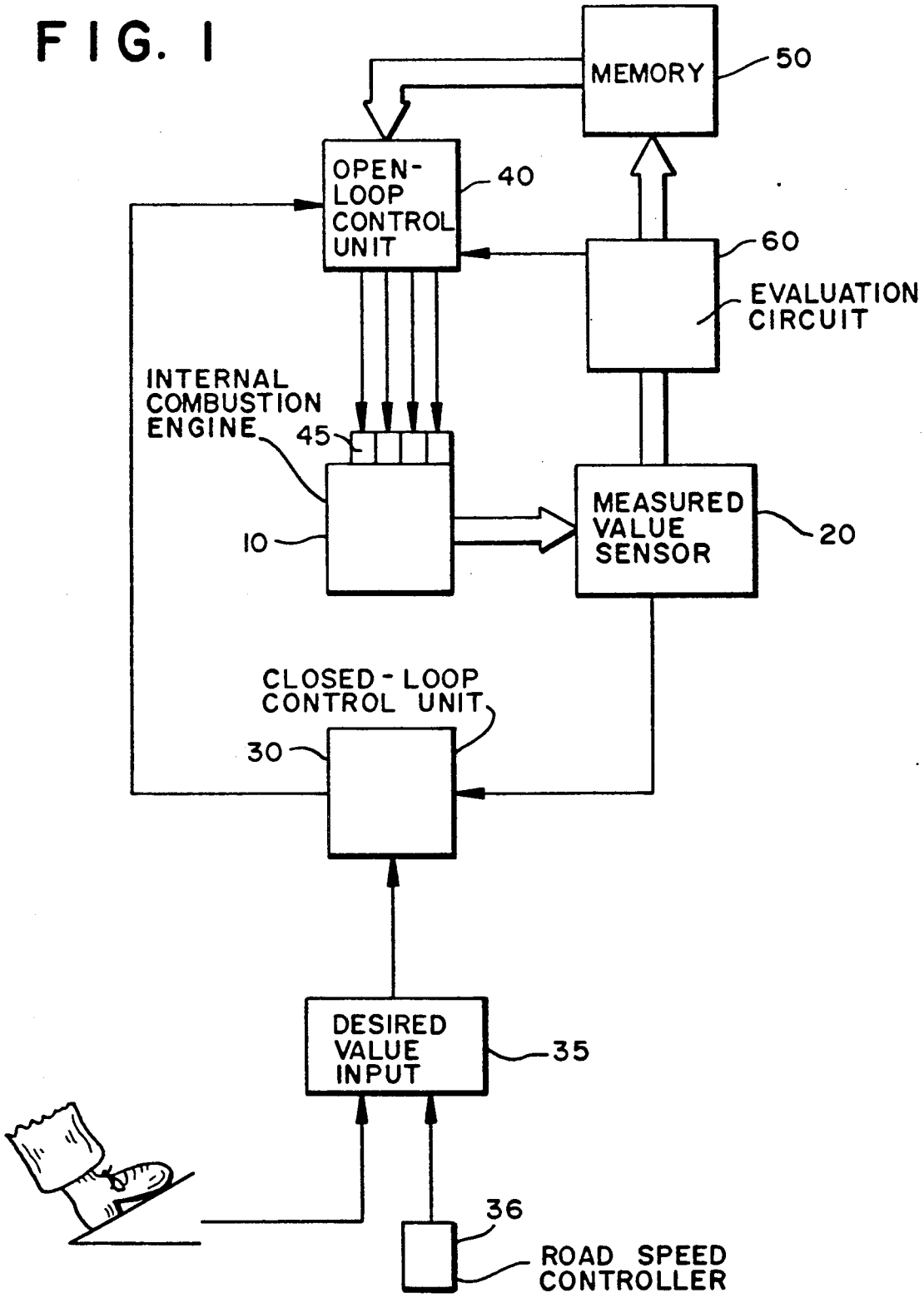
FIG. 1 is a schematic of an electronic open-loop and closed-loop control arrangement for a self-igniting engine.

FIG. 1 shows an electronic open-loop and closed-loop control unit for a self-igniting combustion engine. Various measured-value sensors 20 are mounted on the engine 10. The signals of the measured-value sensors are conducted to an electronic open-loop control unit 30 as well as to an evaluation circuit 60. The electronic control unit 30 generates a quantity signal in dependence upon the output signals of the measured-value sensors 20 and the desired-value input 35. The closed-loop control unit 40 processes the quantity signal, the control pulses of the evaluation circuit 60 and the corrective values stored in a memory 50 to metering signals for the actuators 45 corresponding to each cylinder. The actuators 45 determine the quantity of fuel injected by the pump elements into the individual cylinders. The evaluation circuit 60 receives measured values from the measured-value sensor 20 and emits control pulses to the control unit 40 and corrective values to the memory 50.

During normal operation, the arrangement of FIG. 1 operates in the manner described below.

Different measured-value sensors 20 detect the measured values characterizing the operational condition of the engine. The engine speed N, the lambda value of the exhaust gas, the torque Md, the exhaust gas temperature T and possible other variables are detected. The electronic control unit 30 computes the quantity of fuel to be injected based on actual value and desired value. The actual value results from the signal of the measured-value sensors 20. The output signal of a desired-value input 35 is used as the desired value.

The desired value input determines the desired value based, for example, upon the position of the accelerator pedal; but, it can also use the output signal of a road-speed controller 36. The electronic control unit also considers special operating conditions such as the starting case, fault situations or emergency situations. The electronic control unit can also limit the quantity of fuel to be injected so that specific variables such as exhaust gas temperature, engine speed, lambda, smoke or load are not exceeded.

In conventional arrangements, this quantity signal is supplied to an actuator which charges all cylinders with the same quantity of fuel. Other arrangements include a control unit for each cylinder. In contrast thereto, the arrangement of the invention includes only one electronic control unit for all cylinders which supplies a quantity signal. Based upon this quantity signal and the corrective values stored in the memory 50, the control unit 40 computes the metering signals for the actuators 45 corresponding to the individual cylinders. In this way, only one actuator per engine is present or one actuator is provided for each cylinder.

For example, diesel engines are known wherein the actuators 45 are configured as magnetic valves. The magnetic valves open and close in dependence upon the presence of a metering signal and thereby determine the start and end of fuel metering in the individual cylinders.

The corrective values are advantageously configured so that all cylinders are supplied with the same quantity of fuel or, that the measured values (engine speed, torque or exhaust gas temperature) resulting from the combustions in the individual cylinders are all the same.

The presence of specific operating conditions activates the evaluation circuit 60. The evaluation circuit 60 then supplies control pulses to the control unit 40 and observes the reaction at the measured-value sensors 20. Evaluation circuit 60 then computes corrective values in dependence upon the reaction of the measured-value sensors 20 and these corrective values are then stored in the memory 50. It is advantageous to configure the memory 50 as a memory wherein its content is not lost when the engine is shut off but which can be newly written at any time.

The procedure takes place in an especially advantageous manner at different engine speed and load points and the corrective values are then stored in a characteristic field in dependence on engine speed and load. The quantity signal of the control unit 30 is distributed to the individual cylinders. These metering signals for the individual cylinders are then additively and/or multiplicatively modified by means of the corrective values stored in the memory 50.

The corrective values are determined during the first operation of the engine and compensate for the manufacturing tolerances of the following: the magnetic valves, the pump elements or the remaining components for influencing the quantity of fuel to be injected. This can take place, for example, in the last step of the manufacture of the engine. After the engine is assembled, the first test run is made wherein the corrective values are determined and stored.

If all measured-value sensors necessary for the correction are present in the engine built into the vehicle, then the correction can take place in the context of the service or at suitable steady-state operation points.

The function of the evaluation circuit 60 is explained in the following reference to the drawings. The example shown is for a four cylinder internal combustion engine but the method can easily be transferred to an engine having another number of cylinders.

Figure 2A:
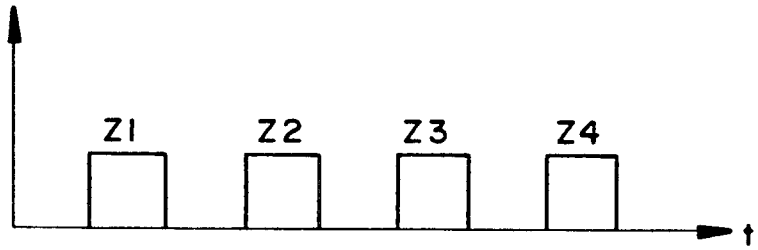
FIGS. 2*a* to 2*d* show the relationship between the drive pulses and the measured value.
Figure 2B:
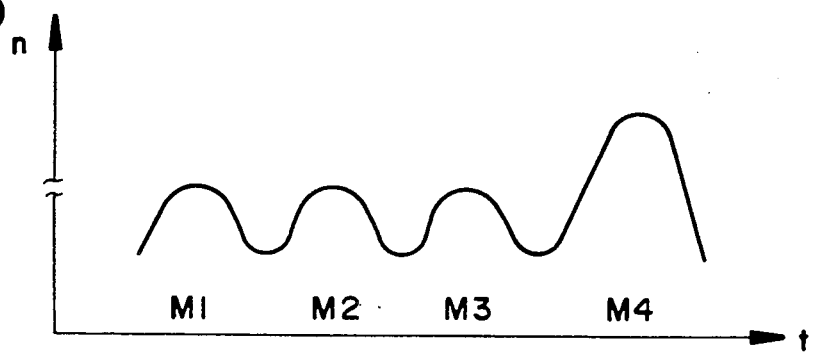

In FIGS. 2*a* and 2*b*, metering signals are shown with and without correction as well as the measured values corresponding thereto. FIG. 2*a* shows the initial metering pulses for which the duration of metering pulses is the same for the individual cylinders. FIG. 2*b* show the torque as a function of time for one combustion cycle; that is, one combustion takes place in each of the cylinders. A lambda signal, an exhaust gas temperature signal or an engine speed signal can be used in lieu of the torque signal.

Figure 2C:
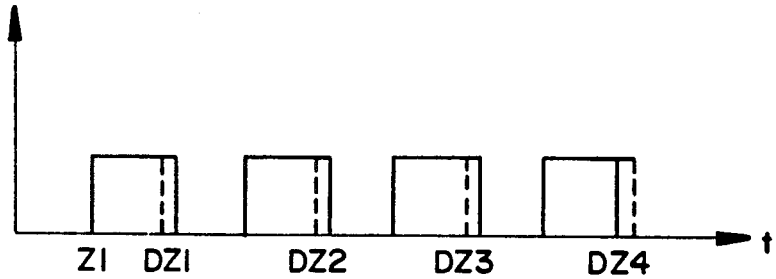
Figure 2D:
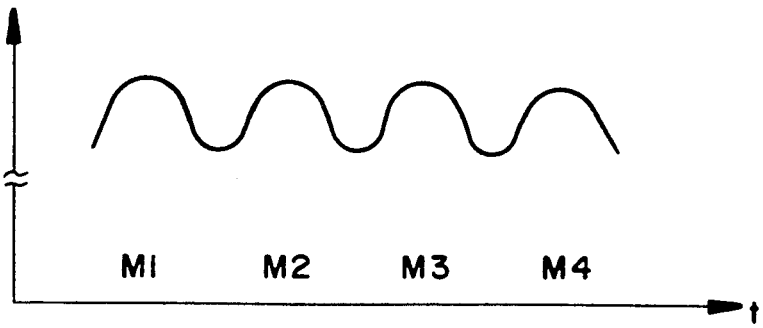

FIG. 2*c* shows the corrected metering signals. In this example, the metering signals for the cylinders 1 to 3 are longer by the value DZ than the original metering signals Zi (i=1, 2, 3, 4). In contrast, the metering signal of cylinder 4 is shorter by the time duration DZ4 than the original metering signal Z4. The measured-value sensors supply measured values corresponding to those shown in FIG. 2*d* when driving with the corrected metering signals. The measured values show a torque as a function of time uniform for all cylinders.

If only one sensor is available for all cylinders, then this cylinder must have an adequate time resolution. This means that the measured-value sensor must react so rapidly to changes that the contributions of the individual cylinders in the course of the signal can be distinguished. If such a rapid sensor is not available, for example for an exhaust gas temperature measurement, then each cylinder must be assigned a measured-value sensor and the measured values of the sensors must be directly evaluated.

Figure 3:
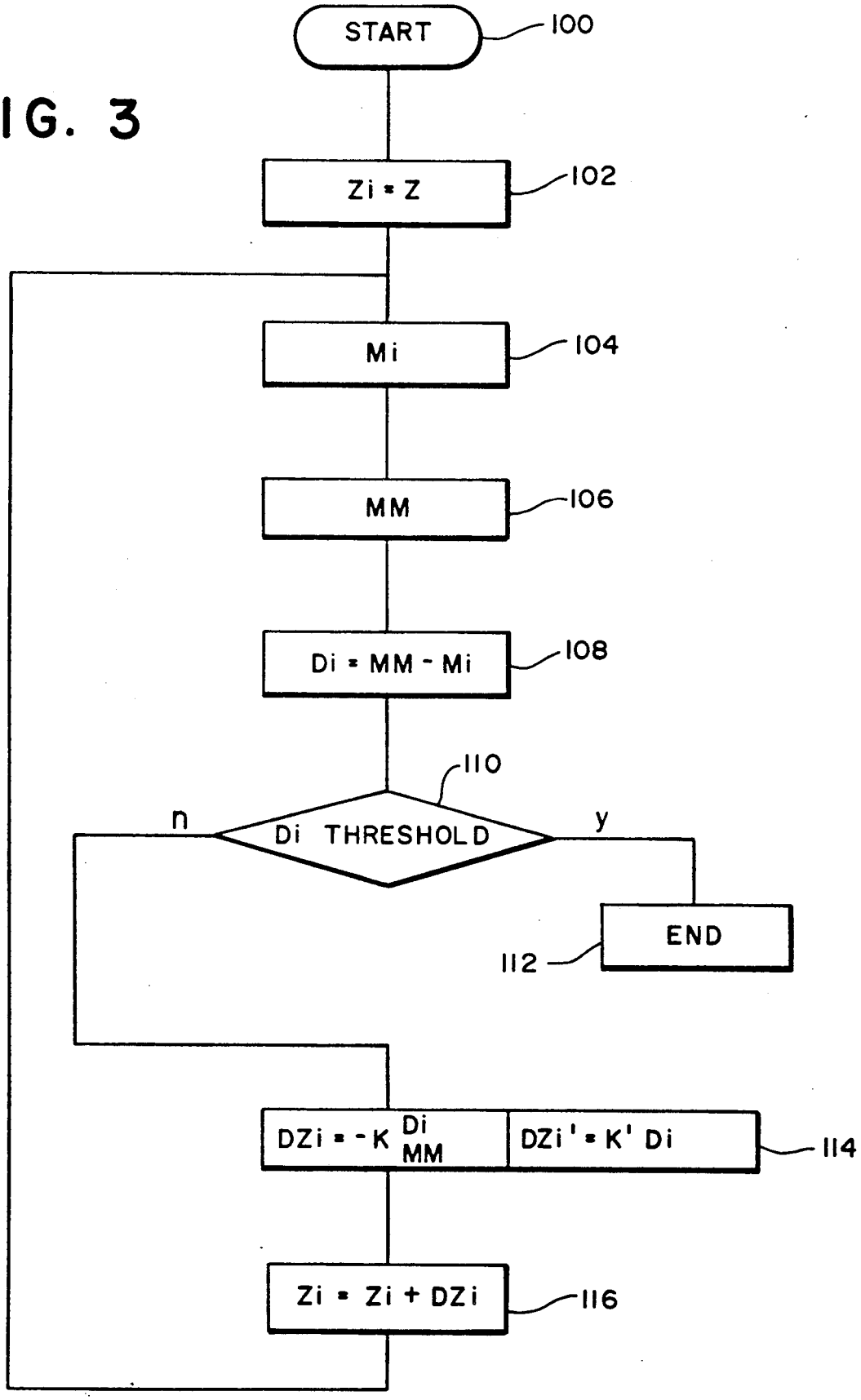
FIG. 3 is a flowchart for determining the corrective values starting with the measured value of the individual cylinders.

The corrective values are determined as shown in the flowchart of FIG. 3. After start 100 of the corrective value determination, the evaluation circuit 60 supplies a control pulse to the control unit 40 in the first step 102 in response to which the control unit 40 meters a defined quantity of fuel to the cylinders. In the case shown, the actuators of the individual cylinders are charged with the metering signal Zi of the same duration Z. The duration Zi (i=1, 2, 3, 4) of the metering signals for the individual cylinders is shown in FIG. 2*a*. In FIG. 2*b*, a measured value (here the torque) as a function of time is shown. Each cylinder is assigned a torque measured value Mi (i=1, 2, 3, 4) which is measured in step 104. In a further step 106, the evaluation circuit computes the mean value MM of the measured values Mi. In a step 108, the differences Di (i=1, 2, 3, 4) between the mean value MM of the individual measured values and the measured values Mi of the individual cylinders are formed. If the decision step 110 detects that all measured values Mi are the same, this means that the differences Di are zero; that is, less than a threshold. Accordingly, the storage of the corrective values DZi in the memory 50 takes place in step 112 and the corrective-value determination is ended. The corrective values DZi determined by the evaluation circuit 60 are permanently stored in memory 50.

In step 114, the evaluation circuit 60 computes corrective values DZi (i=1, 2, 3, 4) in dependence upon the differences Di between the measured values Mi for the individual cylinders and the mean value MM. The corrective values DZi are thereby proportional to the difference Di or to the ratio of the differences Di and the mean value MM. In step 116, evaluation circuit 60, with a control pulse, causes the control unit 40 to consider the determined corrective values in the next metering of fuel. The fuel metering takes place with the corrected metering signals.

Figure 4:
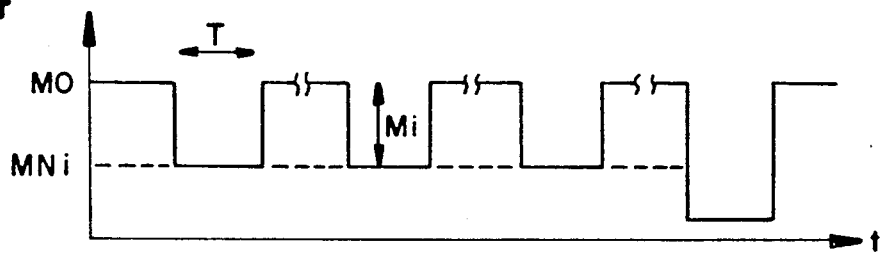
FIG. 4 shows the measured value in dependence upon which cylinder is switched off.
Figure 5:
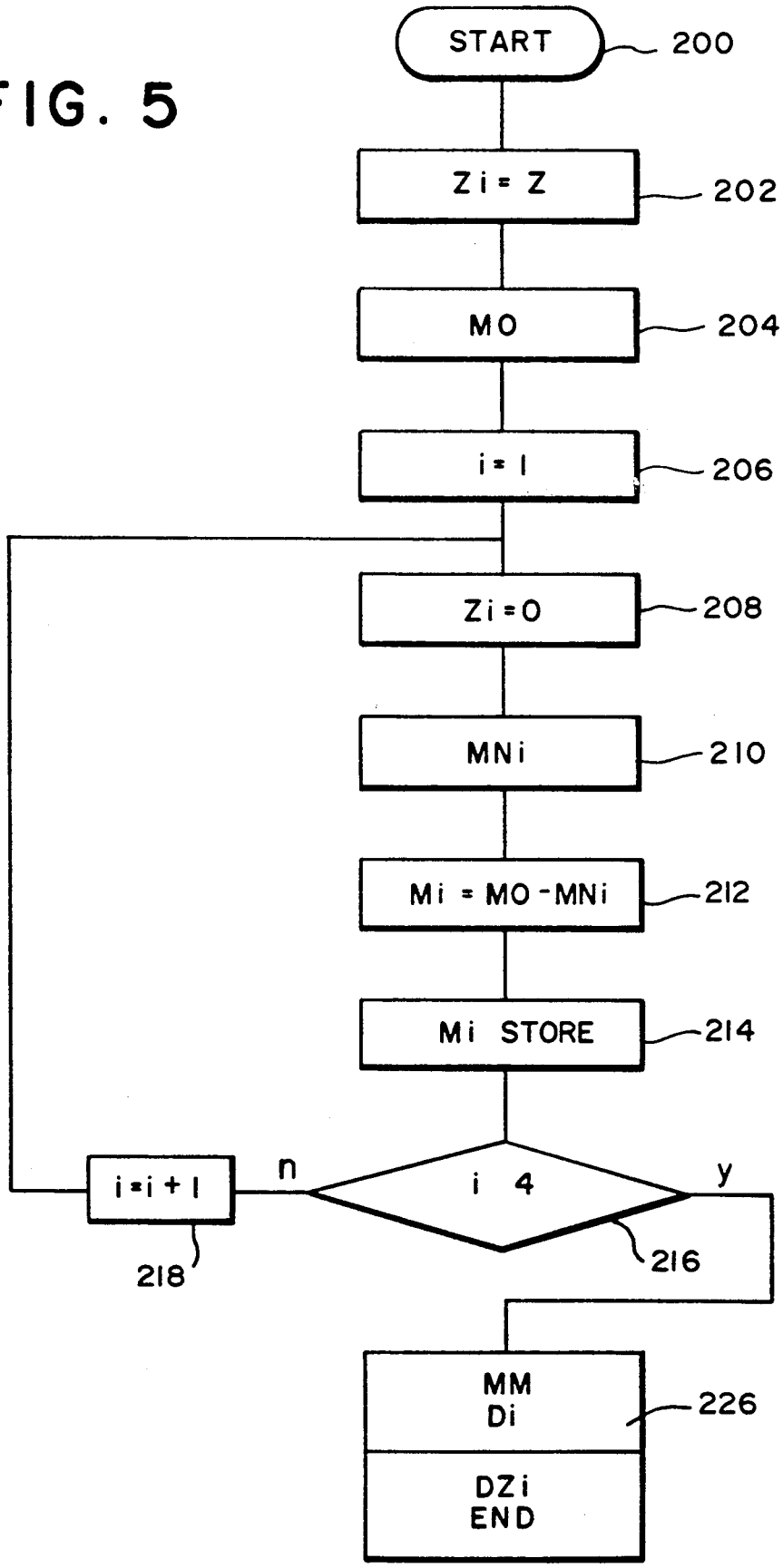
FIG. 5 is a flowchart for showing the determination of the corrective value in dependence upon the quantity reduction for the individual cylinders.

In FIGS. 4 and 5, a further embodiment of the evaluation circuit 60 is shown. For determining the corrective values, the fuel metered to the individual cylinders is sequentially interrupted and the reaction of the measured value detected by the measured-value sensor 20 is observed. If the same quantity of fuel is metered to all cylinders for the same metering signal, then the same change for the measured value always takes place when switching off the metering of fuel to the individual cylinders. If one cylinder, in this case cylinder 4, receives a larger quantity of fuel, the measured value drops more than with the remaining cylinders when the cylinder is shut off.

The reaction of the measured value when the individual cylinders are switched off is shown in FIG. 4. If all cylinders are charged with fuel, then the measured value MO results. If the fuel metered to each cylinder is interrupted for a time duration T, then this results in a reduction of the measured value by the value Mi.

The flowchart of FIG. 5 shows the determination of the corrective value. After the start step 200, the evaluation circuit 60 supplies in step 202 a control pulse to the control unit 40. The control unit generates the metering signals Zi (i=1, 2, 3, 4) because of which all cylinders are supplied with a defined fuel quantity. It is especially advantageous if all metering signals Zi are of the same length. Thereafter, and in step 204, the measured-value sensor 20 detects the measured value MO. In an especially advantageous manner, one of the following values: exhaust gas temperature, lambda value of the exhaust gas, engine speed or torque are used as a measured value and only one sensor is required therefor.

In step 206, a counter i is set to the value 1. In step 202, the metering signals Zi are so selected for an i-th cylinder that no metering of fuel takes place (Zi=0). In step 210, the new measured value MNi is detected. Here, the fuel metering is switched off until the measured value MNi takes on a constant value. In the difference formation 212, the reduction Mi of the measured value is formed from the measured value MO in advance of the switch-off of the i-th cylinder and the new measured value MNi is formed after the switch-off. These values are stored in step 214 until a further processing period. The inquiry unit 216 downstream of step 214 detects whether the counter has already reached the value 4. If i is less than 4, then the counter is increased by 1 (218). In this way, the inquiry recognizes whether the values Mi are detected for all cylinders.

If all measured values Mi for the individual cylinders are detected, then further processing takes place as described in FIG. 3 and the inquiry unit 110 is unnecessary therefor. The steps described with respect to FIG. 3 follow sequentially, namely, step 226, mean value formation 106, difference formation 108, computation of the corrected values 114 for the individual cylinders and storage 112 of the corrective values DZi. An especially advantageous embodiment is that only one measured-value sensor is required. This can, for example, be a measured-value sensor which is already available for the open-loop and closed-loop control of the engine.

Figure 6A:
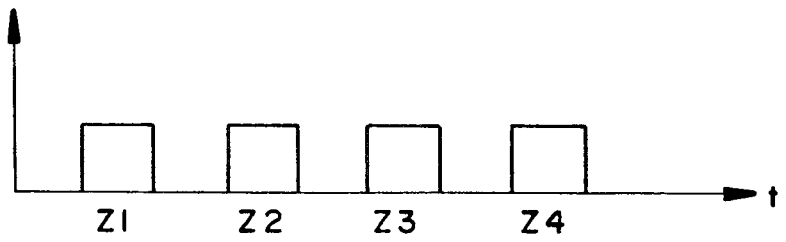
FIG. 6*a* shows the drive signal as a function of time for the individual cylinders.
Figure 6B:
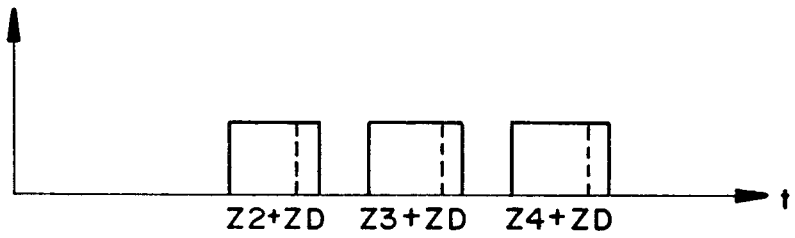
FIG. 6*b* shows the drive signal as a function of time for the individual cylinders with an additional signal for extending the metering signal for the remaining cylinders.
Figure 7:
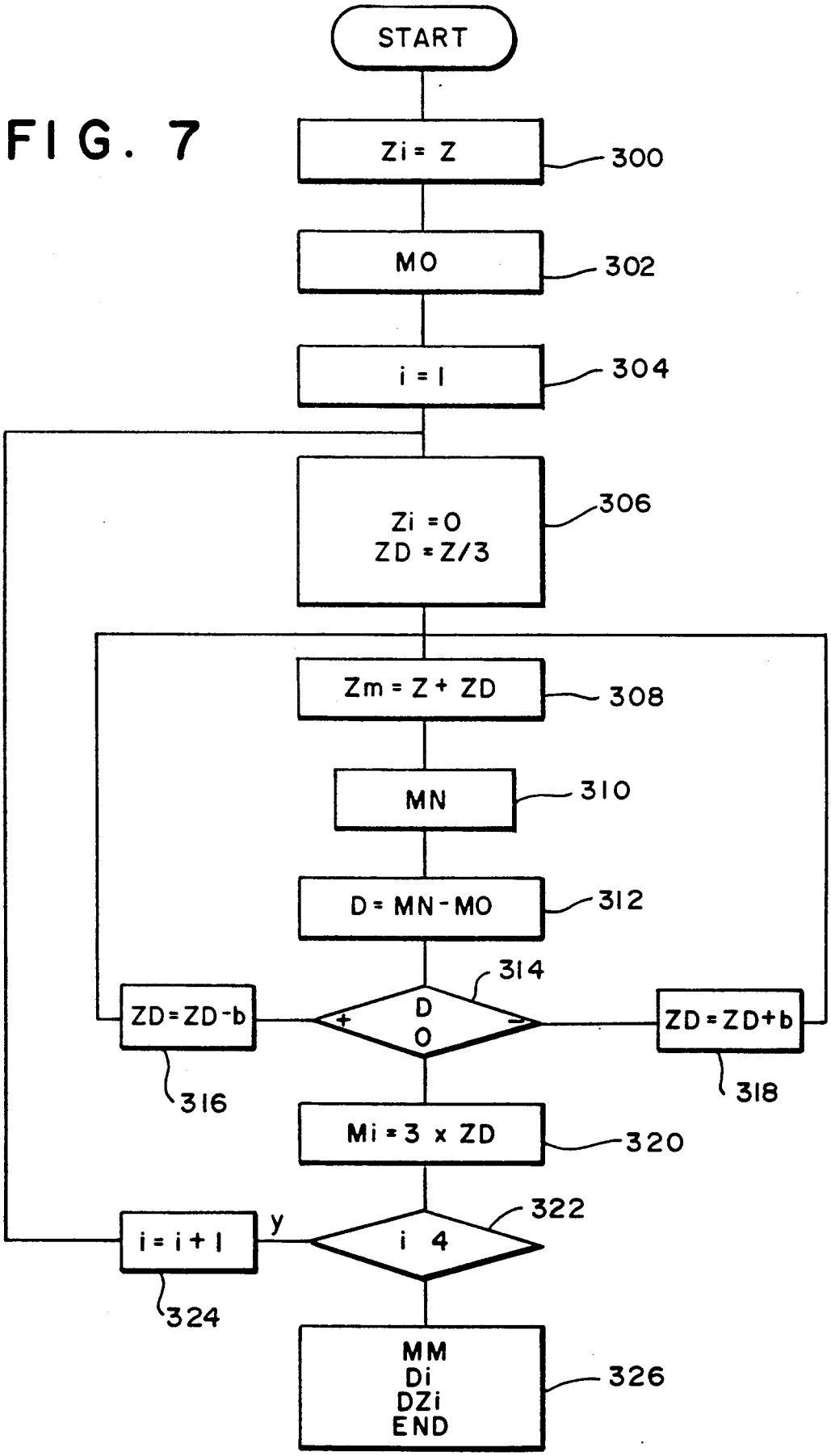
FIG. 7 is a flowchart of a correction method wherein the reduction of the fuel metered to one cylinder is compensated with an additional quantity for the other cylinders.

A further embodiment is shown in FIGS. 6 and 7. FIG. 7 shows a flowchart of the corrective-value determination and in FIG. 6, individual sequences of metering signals are shown in the course of corrective-value determination. In the first corrective step 300, the evaluation circuit 60 generates a control pulse in response to which the control unit 40 emits metering signals. These metering signals are shown in FIG. 6*a* with the metering signals Zi (i=1, 2, 3, 4) for the individual cylinders all being of the same duration Z. With this drive, the measured-value sensor 20 detects in step 302 the measured value MO which is the characteristic for the operation of all cylinders.

In step 304, a counter i is initialized with 1. In a further step 306, a control pulse of the evaluation circuit 60 causes the control unit 40 to charge the actuator of the i-th cylinder with such a measuring signal Z=0 such that no fuel is metered to the cylinder, that is, the cylinder is switched off. Furthermore, an additional signal ZD is computed to extend the metering signals Zm of the remaining cylinders. In step 308, the duration of the metering signals Zm for the remaining cylinders is computed as the sum of the original metering signal Z and the additional signal ZD.

The new measured MN is then detected in step 310. The difference formation 312 determines the difference D of the measured value MO before the switch-off of the i-th cylinder and the measured value MN after the quantity increase in the amount ZD. The decision stage 314 selects the next step in dependence upon the difference D. If the new measured value MN is greater than the value MO in advance of switch off, then the additional quantity ZD is reduced by a small amount (b). If the new measured value is less than the old MO, then the additional quantity ZD is increased by a small amount (b). The step 308 then again follows. If the difference however is zero, that is, less than a pregiven threshold, then $Mi=3*ZD$ is set in step 320.

With the aid of the counter i, the inquiry 322 recognizes whether the metering of fuel to all cylinders has been once interrupted and if the above method has been carried out once. If this is not the case, then the counter i is increased by 1 (324). The further computation of the mean values MM, the difference values Di and the corrective values DZi as well as the storage of the corrective values takes place in correspondence to FIG. 3 (steps 106, 108, 112 and 114).

With the methods described, only a statement as to the absolute outlet variation is obtained. A statement as to the response of the actuator at a defined operating point takes place with the following modification. At the desired operating point, that is for a specific quantity of fuel to be injected, the corrective signal is determined in that a quantity of fuel reduced by a specific amount is injected. In lieu of Zi=0, Zi is reduced by only a small amount. The corrective values for various operating points are computed from the reaction of the measured value to this quantity reduction in correspondence to the embodiment explained above. By means of this modification, a statement as to the change of the injected quantity of fuel for a change of the duration of the metering signal can be made at a desired operating point.

Figure 8A:
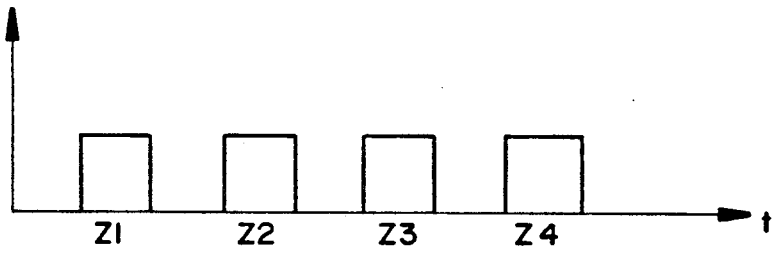
FIG. 8*a* shows the drive pulses as a function of time corresponding to FIG. 6*a*.
Figure 8B:
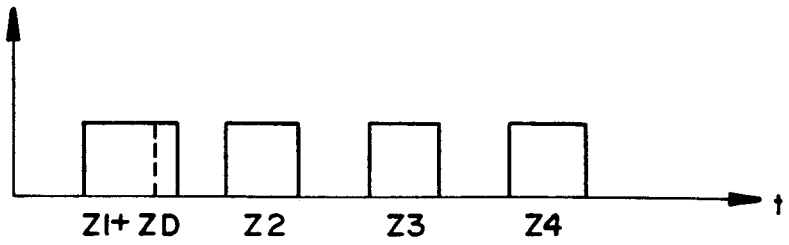
FIG. 8*b* shows the drive pulses as a function of time.
Figure 9:
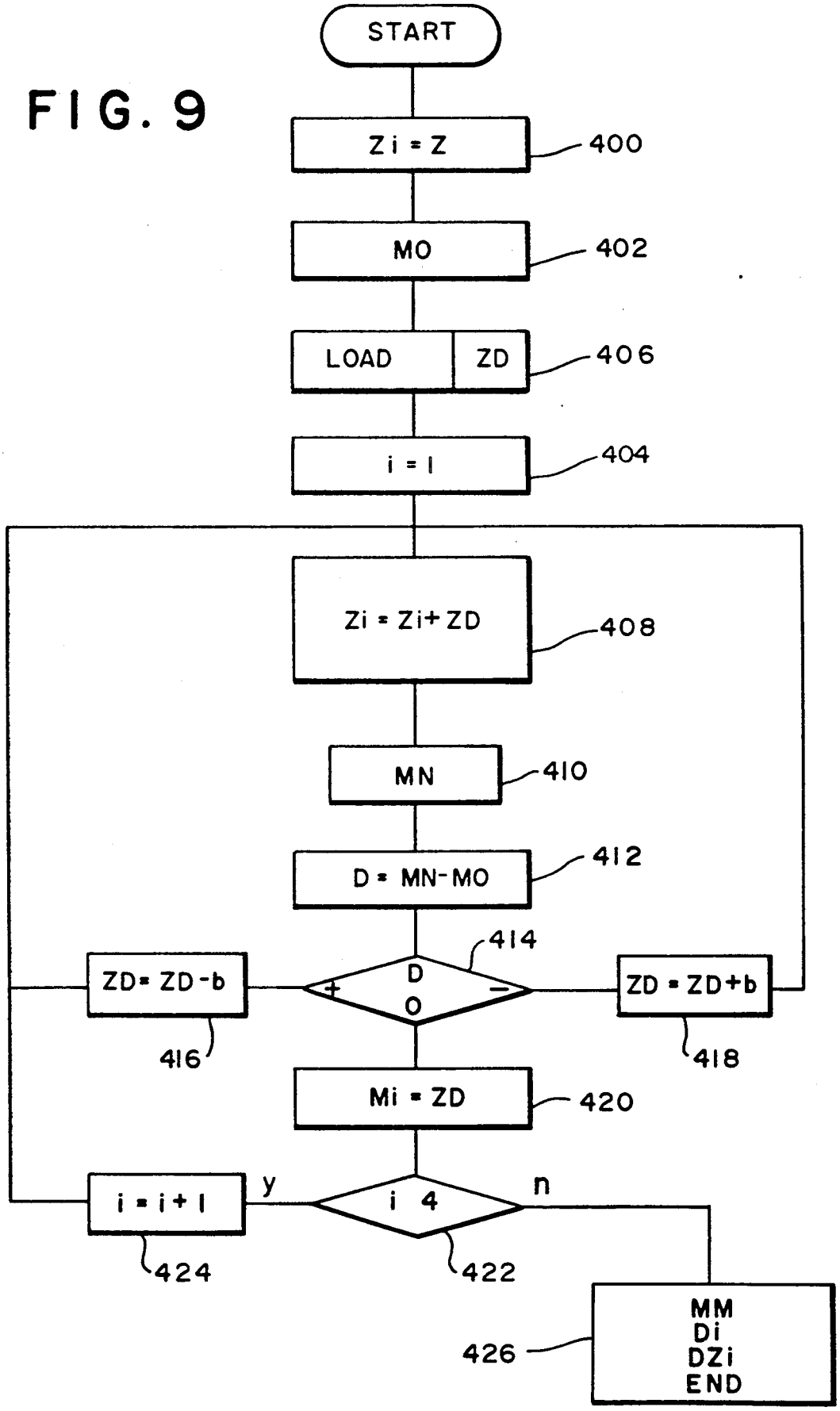
FIG. 9 is a flowchart of a corrective method wherein a defined load is added.

In FIGS. 8 and 9, a further embodiment of the evaluate circuit 60 is illustrated. FIG. 9 again shows the corresponding flowchart. FIGS. 8*a* and 8*b* show different sequences of the metering signal in the course of the determination of the corrective value. In the first step 400 of the correction, all actuators are charged with the same metering signal Zi=Z. In the second step 402, the measured-value sensor 20 detects the measured value MO. An increased load on the engine takes place because a defined consumer load is switched in in step 406. A defined load, for example a generator, is switched in and for this, it is known by what quantity the metered fuel must be increased. The additional signal ZD results from the additional quantity of fuel.

The counter i is set to 1 in step 404 in the manner shown in FIG. 7. In order to maintain the engine speed or the delivered torque at the original value M0, the evaluation circuit 60 supplies a control pulse to the control unit 40 which increases the pulse Zi (see also FIG. 8*b*) for an i-th cylinder by the amount ZD. The new measured value MN is detected (410) and compared with the original MO (412) in correspondence to FIG. 7 (310, 312, 314). The additional quantity ZD is increased (418) or reduced (416) in dependence (414) on this comparison. If the measured value detection supplies the original measured value MO, then Mi is set to equal ZD. The further evaluation takes place as described with respect to the above figures. The inquiry unit 422 corresponding to 322 (in FIG. 7) inquires as to whether the increase ZD has been determined for all cylinders. If this is the case, then the counter i is increased by 1 (424). The further evaluation by the mean value formation and the difference formation takes place as described with respect to FIG. 3.

It is understood that the foregoing description is that of the preferred embodiments of the invention and that various changes and modifications may be made thereto without departing from the spirit and scope of the invention as defined in the appended claims.

What is claimed is:

1. A method for controlling a self-igniting internal combustion engine having a plurality of cylinders and sensor means for measuring at least one of the variables including exhaust gas temperature, lambda value, engine speed and engine torque, an electronic closed-loop control unit for forming a quantity signal for metering fuel and an open-loop control unit for driving an actuator for a specific cylinder, the actuator determining the quantity of fuel injected by a pump element into a cylinder, the method comprising the steps of:

activating corrective means under specific conditions to make ready corrective vales specific to the cylinders for equalizing the cylinders;

sequentially reducing or interrupting the fuel metered to each one of the cylinders and measuring the reaction on the one variable measured by said sensor means to determine the amount by which the measured variable is reduced;

utilizing said corrective means to compute a corrective value for each one of said cylinders in dependence upon the amount determined for the cylinder;

permanently storing the corrective values; and, causing said open-loop control unit to charge said actuators with metering signals in dependence upon said quantity signal and said corrective values.

2. The method of claim 1, wherein said corrective means are activated at the end of the assembly line of the engine manufacturer in specific intervals and/or at selected steady-state operating points.

3. The method of claim 1, wherein the corrective values are computed in dependence upon at least one of the variables exhaust gas temperature, lambda value, engine speed and engine torque.

4. The method of claim 1, wherein the corrective value for each cylinder is computed from an increase of the time duration DZ of the metering signals of the remaining cylinders which is necessary in order to obtain the measured value which is given ahead of the reduction of the fuel metered to each cylinder.

5. The method of claim 1, wherein the corrective values are determined at different operating points.

6. The method of claim 1, wherein the corrective values are stored in dependence upon load and engine speed.

7. An arrangement for controlling a self-igniting internal combustion engine, the arrangement comprising:

sensor means for measuring at least one of the variables including exhaust gas temperature, lambda value, engine speed and engine torque;

an electronic closed-loop control unit for forming a quantity signal for metering fuel to the engine;

a plurality of pump elements for pumping the fuel to be metered to said cylinders;

a plurality of actuators for determining the quantity of fuel to be injected into respective ones of said cylinders by corresponding ones of said pump elements;

an open-loop control for sequentially cylinder-specifically driving individual ones of said actuators for sequentially reducing or interrupting the fuel metered to each one of the cylinders;

corrective means for making available cylinder-specific corrective values;

said corrective means being adapted to measure the reaction on said one variable to determine the amount by which the measured variable is reduced for each one of said cylinders and then determine the corrective value for each one of said cylinders in dependence upon said amount;

said corrective means including torque means for permanently storing said values;

activating means for activating said corrective means under specific conditions; and, said open-loop control unit being adapted to charge said actuators with respective metering signals in dependence upon said quantity signal and said corrective values.

* * * * *